US007412742B2

(12) United States Patent
Esquivel et al.

(10) Patent No.: US 7,412,742 B2
(45) Date of Patent: Aug. 19, 2008

(54) PAINT APPLICATOR

(76) Inventors: Peter S. Esquivel, 4908 N. Roxburgh Ave., Covina, CA (US) 91722-1151; Manuel Esquivel, 4908 N. Roxburgh Ave., Covina, CA (US) 91722-1151; Danny Esquivel, 4908 N. Roxburgh Ave., Covina, CA (US) 91722-1151

( * ) Notice: Subject to any disclaimer, the term of this patent is extended or adjusted under 35 U.S.C. 154(b) by 179 days.

(21) Appl. No.: 11/016,483

(22) Filed: Dec. 17, 2004

(65) Prior Publication Data

US 2006/0174831 A1 Aug. 10, 2006

(51) Int. Cl.
*A46B 9/02* (2006.01)

(52) U.S. Cl. ..... 15/160; 15/210.1; 15/224

(58) Field of Classification Search ..... None
See application file for complete search history.

(56) References Cited

U.S. PATENT DOCUMENTS

| | | | | |
|---|---|---|---|---|
| 1,500,244 | A | 7/1924 | Hartmann | |
| 2,581,563 | A | 1/1952 | Vaughn | 15/160 |
| 2,955,308 | A | 10/1960 | Nelson | 15/106 |
| 3,389,418 | A | 6/1968 | Sencabaugh | 15/244 |
| 3,611,469 | A | 10/1971 | Belli | 15/118 |
| 4,217,854 | A | 8/1980 | Brown | 118/504 |
| 4,224,713 | A * | 9/1980 | Trent | 15/210.1 |
| 4,674,144 | A | 6/1987 | Palmeri | 15/210 R |
| 4,729,143 | A * | 3/1988 | Dawson | 15/210.1 |
| 4,852,203 | A * | 8/1989 | LaBelle | 15/210.1 |
| 4,856,136 | A | 8/1989 | Janssen | 15/244.3 |
| 5,302,205 | A | 4/1994 | Priddy | 118/406 |
| 6,922,865 | B1 * | 8/2005 | Logan, Sr. | 15/114 |

FOREIGN PATENT DOCUMENTS

| | | |
|---|---|---|
| EP | 0 190 369 | 8/1986 |
| GB | 1181230 | 2/1970 |

* cited by examiner

*Primary Examiner*—David A Redding
(74) *Attorney, Agent, or Firm*—Marc Karish; Sheldon Mak Rose & Anderson PC

(57) ABSTRACT

An applicator having a handle; a shank coupled to the handle; a first wall coupled to the shank; a second wall coupled to the first wall, the second wall being perpendicular to the first wall; a third wall coupled to the second wall, the third wall being parallel to the first wall; and an applying surface coupled to the first, second and third walls. The first wall, second wall and the third wall form a U-shaped channel dimensioned to fit around the bottom of a door having a thickness less than about 2 inches.

12 Claims, 6 Drawing Sheets

PAINT APPLICATOR

BACKGROUND OF THE INVENTION

The present invention relates to paint application tools, and more particularly to a tool for applying paint to hard to reach places.

Numerous types of paint applicators are known. However, certain painting surfaces present difficulties to a painter. Among the most difficult surfaces to paint is the bottom of a door. The bottom of a door frequently contacts dirt and moisture. Frequently doors are made from a material, such as wood, that is susceptible to mold, rot and bugs. It is therefore desirable to coat the bottom surface of a door to protect the door from dirt and moisture.

However, painting a bottom of a door presents unique difficulties in terms of time, mess and expense. It is difficult to paint a door while the door is hung in a doorway. Typically, there is very little clearance between the bottom of the door and the ground. A cover must be placed on the ground to protect the ground from drips and spills. Additionally, where the ground is carpeted, there may not be enough clearance to even access the bottom of a door. Even where access to the bottom of a hung door exists, the painter typically has to lay flat on the ground and contort the paint brush to reach the surface, thereafter applying small, repetitive strokes in an attempt to fully coat the bottom of the door. Such a procedure is time consuming, wastes paint and often inadequately coats the bottom of the door, thereby leaving the door vulnerable to mold, rot and bugs.

Alternatively, a painter may remove a hung door, paint the bottom surface of the door, and then re-hang the door. Such a process is time consuming, may damage the hinges of the door or the door itself, and may require the use of specialized tools. Thus, there is a need for an improved device for painting the bottom surface of doors.

SUMMARY OF THE INVENTION

Accordingly, the present invention is directed to an applicator having a handle; a shank coupled to the handle; a first wall coupled to the shank; a second wall coupled to the first wall, the second wall being perpendicular to the first wall; a third wall coupled to the second wall, the third wall being parallel to the first wall; and an applying surface coupled to the first, second and third walls. The first, second, and thirds wall form a U-shaped channel dimensioned to fit around the bottom of a door having a thickness less than about 2 inches.

In a first embodiment of the present invention, the first wall and the third wall each have a length of from about ½ inch to about 1 inch; the second wall has a length of from about 2¼ inches to about 2¾ inches; and the applying surface has a thickness of from about ⅛ inch to about ⅜ inch. Preferably, each of the first, second and third walls have a width of from about 2 inches to about 4 inches. Optionally, the applying surface comprises a sponge or short nylon bristles in a rubbery base.

The shank may have a first portion coupled to the handle, the first portion having a length of at least about 2 inches; a second portion coupled to the first portion, the second portion being perpendicular to the first portion and having a length of from about 1 inch to about 1½ inches; and a third portion coupled to the second portion, the third portion being parallel to the first portion and having a length of from about ⅛ to about ⅜ inches. Optionally, the handle has a hole for attachment of an extension. The handle may have contours corresponding to fingers of a human hand.

In a second embodiment of the present invention, the first wall and the third wall each have a length of from about 2 inches to about 2⅜ inches; the second wall has a length of from about 2½ inches to about 3 inches; and the applying surface has a thickness of from about ⅛ inch to about ½ inch.

An applicator according to a third embodiment of the present invention has a handle; a shank coupled to the handle; a first wall coupled to the shank; a second wall coupled to the first wall, the second wall being perpendicular to the first wall; and an applying surface coupled to the first and second walls. The first wall and second wall form a L-shaped channel dimensioned to fit under the bottom of a door having a thickness less than about 3 inches. Optionally, the first wall has a length of from about ½ inch to about 2 inches; the second wall has a length of from about 3 inches to about 3½ inches; and the applying surface has a thickness of from about ⅛ inch to about ½ inches.

The shank may have a first portion coupled to the handle, the first portion having a length of at least about 2 inches; a second portion coupled to the first portion at an angle of between about 90 degrees and about 130 degrees, the second portion having a length of from about 1 inch to about 1½ inches; and a third portion coupled to the second portion and to the first wall, the third portion being perpendicular to the second portion and the first wall and having a length of from about ⅛ inch to about ½ inch. Alternatively, the shank may have a first portion coupled to the handle, the first portion having a length of at least about 2 inches; and a second portion coupled to the first portion at an angle of about 90 degrees to about 120 degrees, the second portion being coupled to the first wall at an angle of about 60 degrees to about 90 degrees and having a length of from about ½ inch to about 1 inch.

The present invention is also directed to a method for making a paint applicator comprising the steps of forming a material into a shank; a first wall coupled to the shank; a second wall coupled to the first wall, the second wall being perpendicular to the first wall; and a third wall coupled to the second wall, the third wall being parallel to the first wall. A handle is attached to the shank and an applying surface is coupled to the first, second and third walls. The first wall, second wall and the third wall form a U-shaped channel dimensioned to fit around the bottom of a door having a thickness less than about 2 inches. Alternatively, a material is formed into a shank; a first wall coupled to the shank; and a second wall coupled to the first wall, the second wall being perpendicular to the first wall. The first and second walls form an L-shaped channel dimensioned to fit around the bottom of a door having a thickness less than about 3 inches.

BRIEF DESCRIPTION OF DRAWINGS

These and other features, aspects, and advantages of the present invention will become better understood with reference to the following description, appended claims, and accompanying drawings, where:

DETAILED DESCRIPTION

Figure 1:
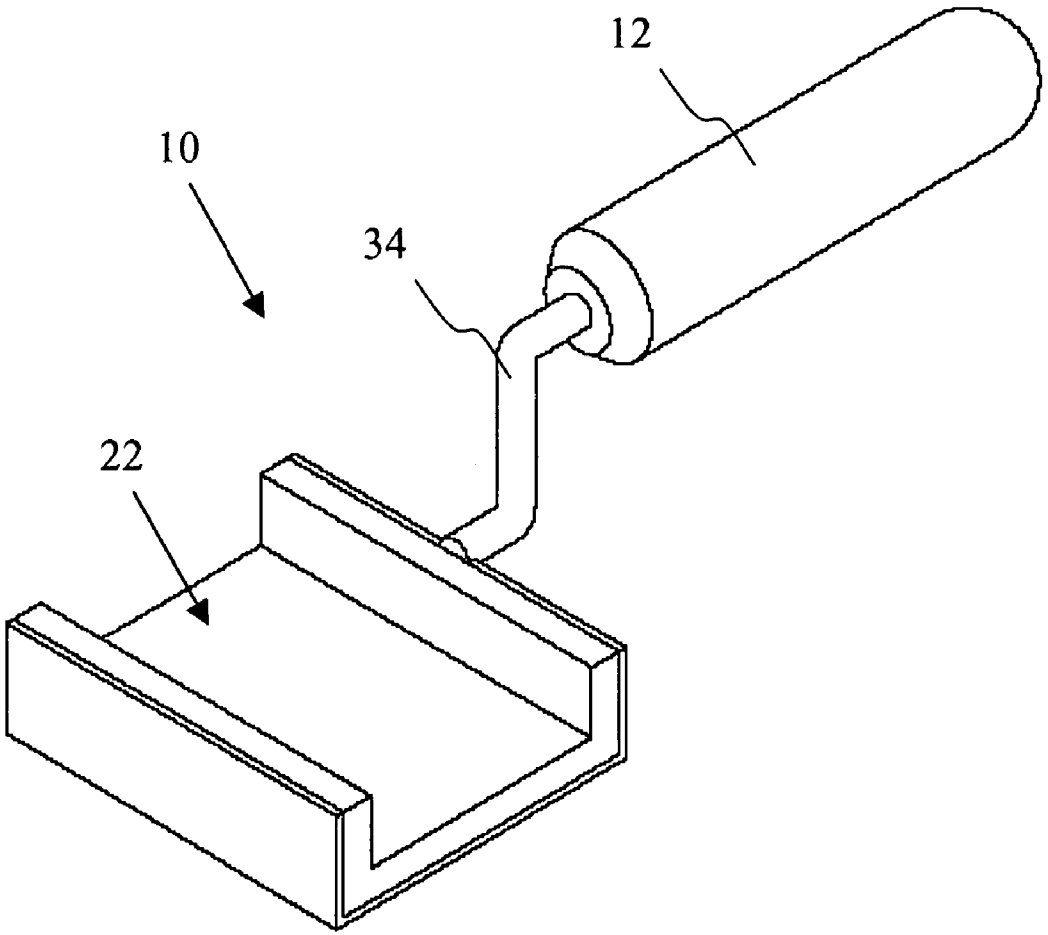
FIG. 1 is a top perspective view of a paint applicator according to a first embodiment of the present invention.
Figure 2:
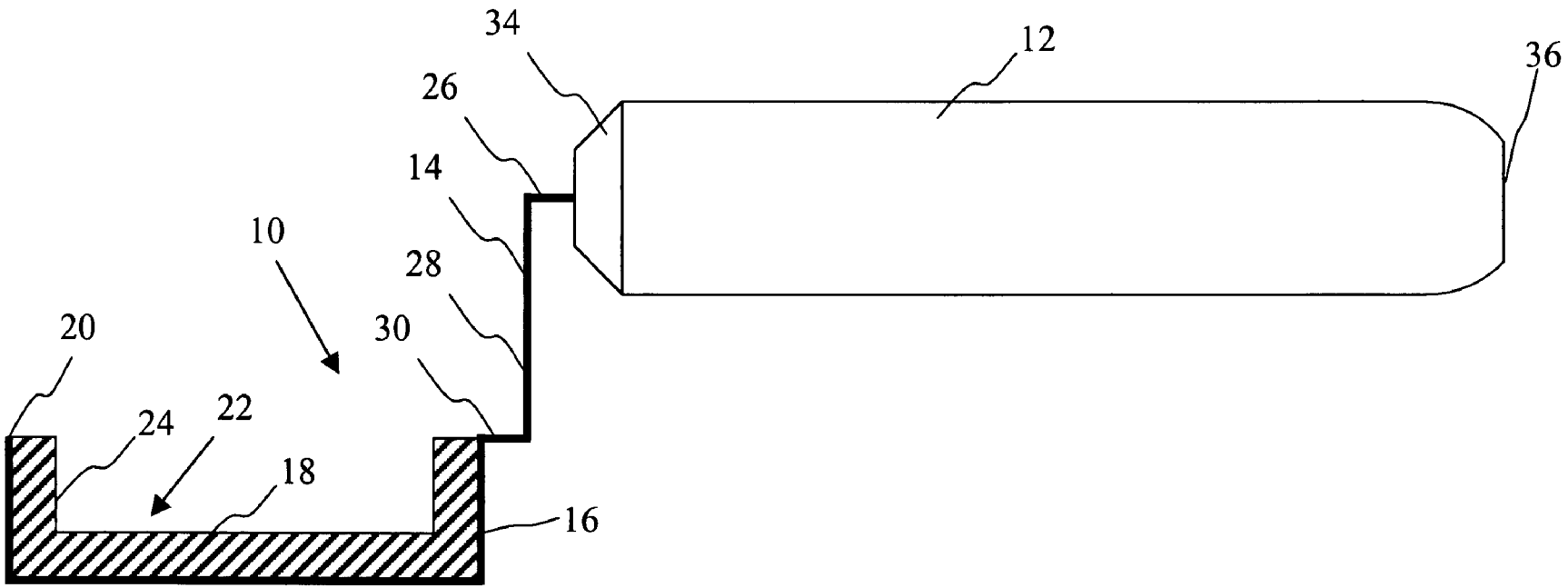
FIG. 2 is a side elevation view of the paint applicator of FIG. 1.

Turning now to the drawings, FIG. 1 is a perspective view and FIG. 2 is a side elevational view of a paint applicator 10 according to a first embodiment of the present invention. As shown in FIG. 1, the paint applicator 10 has a handle 12. The handle 12 is coupled to a shank 14 which is coupled to a first wall 16. The first wall 16 is coupled to a second wall 18 perpendicular to the first wall 16. The second wall is coupled a third wall 20 which is parallel to the first wall 16. The first, second and third walls form a U-shaped channel 22.

The shank, first, second, and third walls may be made from metal, wood, or plastic. In a preferred embodiment, the first second, and third walls are made of 1/16" thick stainless steel. A paint applying surface 24 is coupled to each of the first, second and third walls on an inside of the U-shaped channel 22. In an embodiment, the paint applying surface is a natural or synthetic sponge. Alternatively, the paint applying surface 24 may have a plurality of bristles formed of a natural or synthetic fiber such as nylon. The fiber may be fixed in a rubbery base.

In the first embodiment, the paint applying surface has a thickness of from about ⅛ inch to about ⅜ inch. In the first embodiment, each of the first and third walls are from about ½ inch to about 1 inch in length, the second wall is from about 2¼ inches to about 2¾ inches in length, thereby forming a U-shaped channel fittable around the bottom of a door having a thickness less than about 2 inches. Preferably, the first, second, and third walls have a width of from about 2 inches to about 4 inches, and more preferably from about 2.5 inches to about 3.5 inches so that the paint applicator 10 can efficiently apply paint to a large portion of a door.

The shank 14 has a first portion 26 coupled to the handle 12, the first portion having a length of from about 2 inches to about 4 inches. Preferably, the handle is mounted around at least 1½ inches of the first portion of the shank, and more preferably around at least about 2 inches of the first portion of the shank. Preferably, the handle is mounted to the first portion 26 of the shank 14 so as to leave from about ⅛ inch to about ⅜ inch of the first portion exposed. The shank has a second portion 28 perpendicular to the first portion from about 1 inch to about 1½ inches in length, and a third portion 30 parallel to the first portion about from about ⅛ inch to about ⅜ inch in length.

The shape of the shank allows a user to hold the applicator parallel to the bottom surface of the door, at a position slightly higher than the bottom of the door, and ensures that only the paint applicator surface touches the door, so as not to disturb other surfaces having wet paint. As will be understood by those skilled in the art, the angles between one or more of the first, second and third portions of the shank, the angle between the first portion of the shank and the handle, and the angle between the third portion of the shank and the first wall may be varied to achieve a different position and angle of the handle relative to the U-shaped channel.

The handle 12 may be made of wood, metal, and plastic, as well as other materials known in the art for making handles. Preferably the handle 12 is formed as a cylinder. In an embodiment, the handle is a wood cylinder having a metal collar 34 helping couple the handle to an end of the shank. Additionally, an end of the handle not coupled to the shank may be given a threaded hole 36 to allow attachment of the handle to an extension. For example, the end of the handle not coupled to the shank may have a ⅝" I.D. threaded hole to fit a male counterpart with a ⅝" O.D. male screw, as found on a standard broom handle. In an embodiment, the handle has a length of at least about 5 inches.

Figure 3:
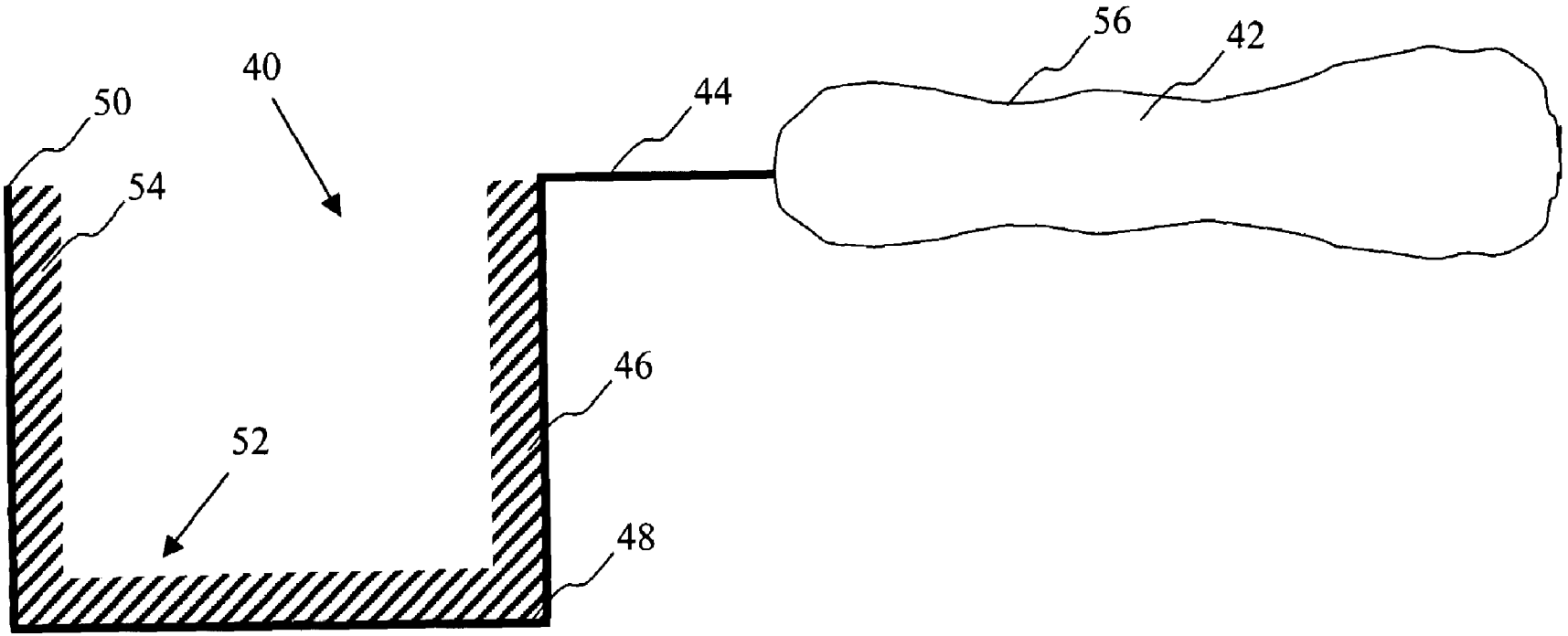
FIG. 3 is a side elevation view of a paint applicator according to a second embodiment of the present invention.

A second embodiment of the paint applicator 40 of the present invention is shown in FIG. 3. A handle 42 is coupled to a shank 44 which is coupled to a first wall 46. The first wall 46 is coupled to a perpendicular second wall 48 which is coupled to a third wall 50 parallel to the first wall 46, thereby forming a U-shaped channel 52. Preferably, the first and third walls have a length of from about 2 inches to about 2⅜ inches. Preferably, the second wall has a length of from about 2½ inches to about 3 inches. A paint applicator surface 54, such as a sponge, having a thickness of from about ⅛ inch to about ½ inch is applied to the first, second, and third walls on an inside of the U-shaped channel 52.

Preferably, the first and third walls 46, 50 each have a thickness of about 1/16", thereby leaving the U-shaped channel 52 with an inner opening of about 2 inches, which can be placed around the bottom of a standard door having a thickness of 2 inches or less. The first and second walls paint the sides of the door up to about 2" from the bottom surface. Preferably, the first, second and third walls have a width of from about 2 inches to about 4 inches. The length and width of the U-shaped portion allows the device to efficiently apply paint to the bottom of a door and prevents the device from being disengaged from the bottom of a door.

In contrast to the shank of the first embodiment which contains multiple bends to place the handle in an elevated position relative to the U-shaped channel, the shank 44 of the second embodiment is straight, thereby leaving the handle 42 no higher than the top of the U-shaped channel 52. Preferably, the shank 44 has a length of at least about 2¼ inches and the handle 42 is mounted to the shank so as to leave from about ¾ inch to about 1¼ inches exposed. As an alternative to the cylindrical handle previously discussed, the handle 42 may have contours 56 designed to hold gripping fingers of a human hand.

Figure 4:
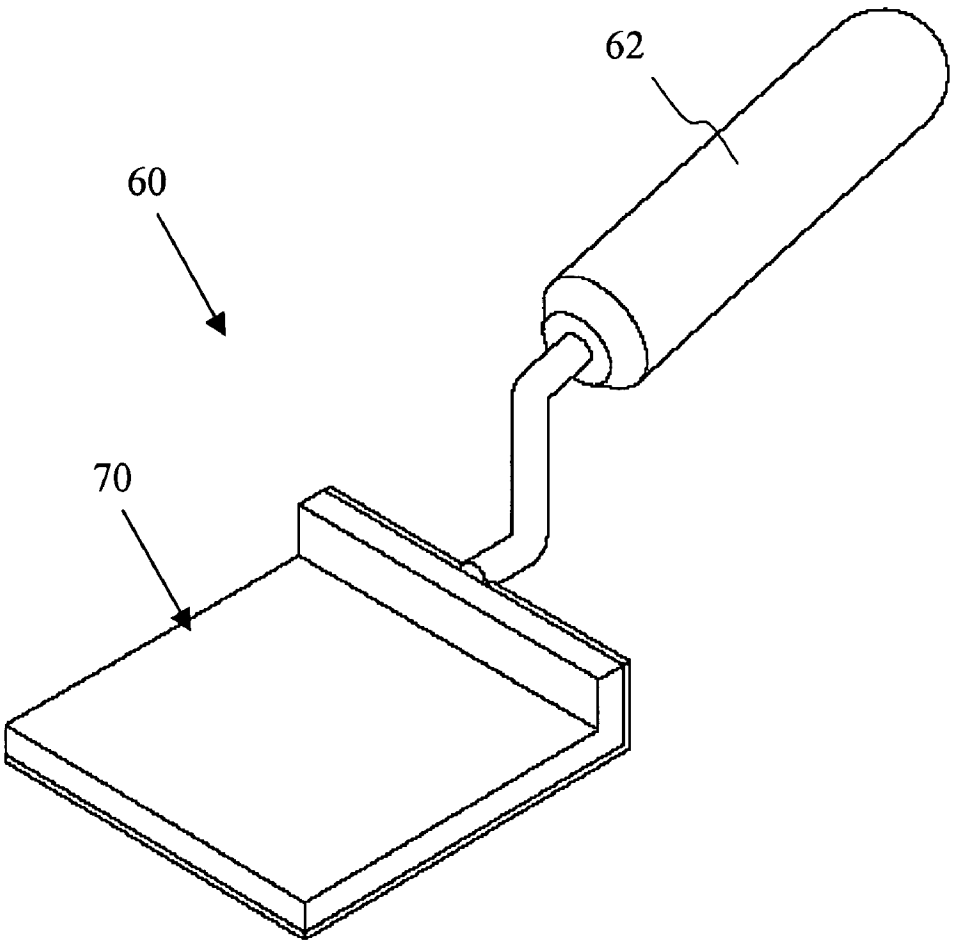
FIG. 4 is a top perspective view of a paint applicator according to a third embodiment of the present invention.
Figure 5:
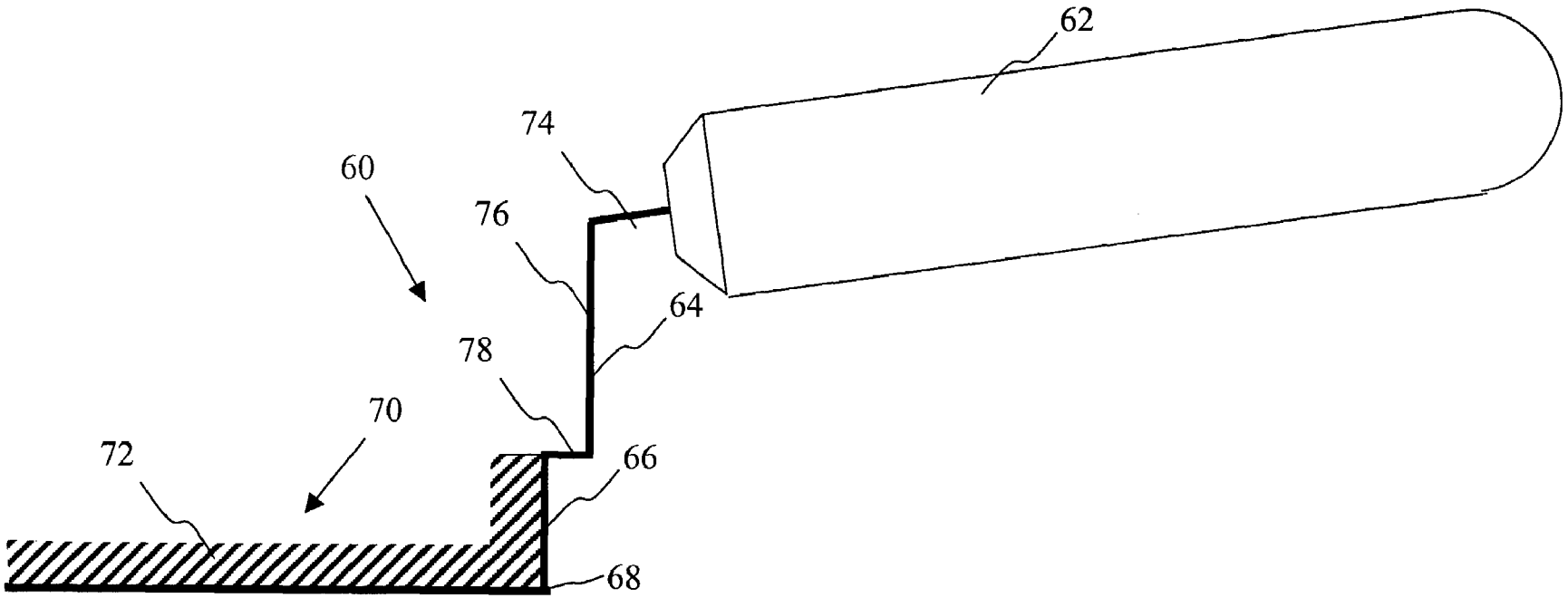
FIG. 5 is a side elevation view of the paint applicator of FIG. 4.

A third embodiment of the paint applicator 60 of the present invention is shown in FIGS. 4 and 5. A handle 62 is coupled to a shank 64 which is coupled to a first wall 66. The first wall 66 is coupled to a second wall 68 perpendicular to the first wall, thereby forming an L-shaped channel 70. The first wall 66 has a length of from about ½ inch to about 2 inches, and more preferably from about ½ inch to about 1 inch. The second wall 68 has a length of from about 3 inches to about 3½ inches, thereby enabling the L-shaped channel 70 to apply paint across the bottom surface of doors having a thickness less than about 3 inches. A paint applicator surface 71, such as a sponge, having a thickness of from about ⅛ inch to about ½ inch is applied to the first and second walls on an inside of the L-shaped channel 70.

The shank 64 has a first portion 74 at least about 2 inches long coupled to the handle 62. Preferably, the handle 62 is mounted to the first portion 74 so as to leave about ¼ inch to about ½ inch exposed. A second portion 76 from about 1 inch to about 1½ inches long is arranged at an angle from about 90 degrees to about 130 degrees relative to the first portion 74. A third portion 78 from about ⅛ inch to about ½ inch long perpendicular to the second portion 74 is coupled to the second portion. The third portion 78 is coupled to the first wall 66. The shape and dimensions of the shank 64 allow a painter to comfortably hold the applicator from above, in a position where they are not likely to contact the surface of the door which may be wet, and apply paint to the bottom of a door.

Figure 6:
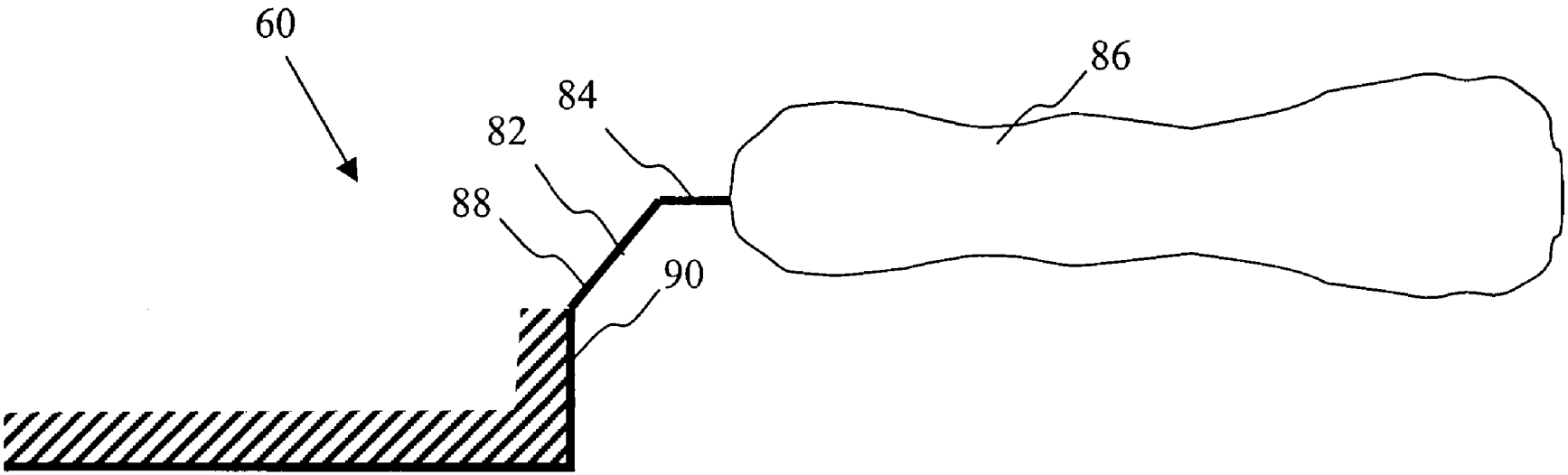
FIG. 6 is a side elevation view of a paint applicator according to a fourth embodiment of the present invention.

In a fourth embodiment of the paint applicator 80 of the present invention, as shown in FIG. 6, the shank 82 consists of a first portion 84 coupled to a handle 86. The first portion 84 has a length of at least about 2 inches. Preferably, the handle 86 is coupled to the first portion 84 so as to leave from about ¼ inch to about ½ inch exposed. A second portion 88 is coupled to the first portion 84 at an angle of about 90 degrees to about 120 degrees relative to the first portion 84. The second portion has a length of from about ½ inch to about 1 inch, and more preferably from about ½ inch to about ¾ inch. The second portion is coupled to a first wall 90 at an angle of from about 60 degrees to about 90 degrees.

The present invention is also directed to a method for making a paint applicator. In an embodiment, a sheet of stainless steel is cut into a form. The form has a first rectangular portion, having a first width, and a second rectangular portion having a second width, the second width being smaller than the first width. The form has a tapered portion with a width tapering from the first width to the second width.

The first portion is bent by machine, or by hand, to form either a U-shaped channel or an L-shaped channel having the dimensions described above. The tapering portion and the second rectangular portion are then bent to form a shank having lengths and angles as described above. A handle is attached to the shank. The handle may be attached using an adhesive, such as glue, or via a fastener, such as a screw extending through the handle and the shank. The portion of the shank attached to the handle may be further bent, and holes may be drilled through the shank, to help mount the handle. A paint applying surface, such as short and soft nylon bristles in a rubbery base, is glued to the U-shaped or L-shaped channel.

Alternatively, the paint applicator may be made of a single piece of plastic molded into a U-shaped or L-shaped channel and a shank. The handle may be attached to the plastic shank using an adhesive or via a fastener. Optionally, the U-shaped or L-shaped channel, shank and handle may be a single piece of molded plastic.

Although the present invention has been described in considerable detail with reference to certain preferred versions thereof, other versions are possible. Therefore, the spirit and scope of the appended claims should not be limited to the description of the preferred versions described herein. When describing portions or elements of the device as "coupled" to each other, the applicants intend to include unitary structures having the described portions or elements as well as structures attached to each other with adhesives, fasteners or via fastening techniques such as welding.

All features disclosed in the specification, including the claims, abstracts and drawings, and all the steps in any method or process disclosed, may be combined in any combination except a combination where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" or "step" clause as specified in 35 U.S.C. §112.

We claim:

1. An applicator comprising:

a handle;

a shank coupled to the handle;

a first wall coupled to the shank;

a second wall coupled to the first wall, the second wall being perpendicular to the first wall;

a third wall coupled to the second wall, the third wall being parallel to the first wall; and an applying surface coupled to the first, second and third walls;

wherein the first wall, second wall and the third wall form a U-shaped channel dimensioned to fit around the bottom of a door having a thickness less than about 2 inches; and wherein the shank is configured so that when the applying surface of the second wall is facing upwards the handle is higher in elevation than the second wall to allow a user to hold the applicator around the bottom surface of a hung door.

2. The applicator of claim 1 wherein: the first wall and the third wall each have a length of from about ½ inch to about 1 inch;

the second wall has a length of from about 2¼ inches to about 2¾ inches; and the applying surface has a thickness of from about ⅛ inch to about ⅜ inch.

3. The applicator of claim 2 wherein each of the first, second and third walls have a width of from about 2 inches to about 4 inches.

4. The applicator of claim 2 wherein the applying surface comprises a sponge.

5. The applicator of claim 2 wherein the applying surface comprises nylon bristles.

6. The applicator of claim 2 wherein the shank further comprises:

a first portion coupled to the handle, the first portion having a length of at least about 2 inches;

a second portion coupled to the first portion, the second portion being perpendicular to the first portion and having a length of from about 1 inch to about 1½ inches; and a third portion coupled to the second portion, the third portion being parallel to the first portion and having a length of from about ⅛ to about ⅜ inches.

7. The applicator of claim 2 wherein the handle further comprises a hole for attachment of an extension.

8. The applicator of claim 2 wherein the handle further comprises contours corresponding to fingers of a human hand.

9. The applicator of claim 1 wherein:

the first wall and the third wall each have a length of from about 2 inches to about 2⅜ inches;

the second wall has a length of from about 2½ inches to about 3 inches; and the applying surface has a thickness of from about ⅛ inch to about ½ inch.

10. An applicator comprising:

a handle;

a shank coupled to the handle;

a first wall coupled to the shank, the first wall having a length of from about ½ inch to about 2 inches;

a second wall coupled to the first wall, the second wall being perpendicular to the first wall and having a length of from about 3 inches to about 3½ inches; and an applying surface coupled to the first and second walls, the applying surface having a thickness of from about ⅛ inch to about ½ inches;

wherein the first wall and second wall form an L-shaped channel dimensioned to fit under the bottom of a door having a thickness less than about 3 inches;

wherein the shank further comprises:

a first portion coupled to the handle, the first portion having a length of at least about 2 inches;

a second portion coupled to the first portion at an angle of between about 90 degrees and about 130 degrees, the second portion having a length of from about 1 inch to about 1½ inches; and a third portion coupled to the second portion and to the first wall, the third portion being perpendicular to the second portion and the first wall and having a length of from about ⅛ inch to about ½ inch.

11. An applicator comprising:

a handle;

a shank coupled to the handle;

a first wall coupled to the shank, the first wall having a length of from about ½ inch to about 2 inches;

a second wall coupled to the first wall, the second wall being perpendicular to the first wall and having a length of from about 3 inches to about 3½ inches; and an applying surface coupled to the first and second walls, the applying surface having a thickness of from about ⅛ inch to about ½ inches;

wherein the first wall and second wall form an L-shaped channel dimensioned to fit under the bottom of a door having a thickness less than about 3 inches;

wherein the shank further comprises:

a first portion coupled to the handle, the first portion having a length of at least about 2 inches; and a second portion coupled to the first portion at an angle of about 90 degrees to about 120 degrees, the second portion being coupled to the first wall at an angle of about 60 degrees to about 90 degrees and having a length of from about ½ inch to about 1 inch.

12. A method for making a paint applicator comprising: forming a material into:

a shank;

a first wall coupled to the shank;

a second wall coupled to the first wall, the second wall being perpendicular to the first wall;

a third wall coupled to the second wall, the third wall being parallel to the first wall;

attaching a handle to the shank; and coupling an applying surface to the first, second and third walls;

wherein the first wall, second wall and the third wall form a U-shaped channel dimensioned to fit around the bottom of a door having a thickness less than about 2 inches; and wherein the shank is configured so that when the applying surface of the second wall is facing upwards the handle is higher in elevation than the second wall to allow a user to hold the applicator around the bottom surface of a hung door.

* * * * *